United States Patent [19]

Burt

[11] Patent Number: 4,715,608

[45] Date of Patent: Dec. 29, 1987

[54] EDUCATIONAL GAME APPARATUS

[76] Inventor: Johanna Burt, 2125 Palm Vista Dr., Apopka, Fla. 32703

[21] Appl. No.: 934,499

[22] Filed: Nov. 24, 1986

[51] Int. Cl.[4] ..... A63F 3/00

[52] U.S. Cl. ..... 273/248

[58] Field of Search ..... 273/243, 248, 249, 258, 273/272

[56] References Cited

U.S. PATENT DOCUMENTS 2,717,156 9/1955 Nelson ..... 273/248

OTHER PUBLICATIONS

"What's The Word" game; copyright 1984, Karian Corporation.

*Primary Examiner*—Richard C. Pinkham

*Assistant Examiner*—Matthew L. Schneider

*Attorney, Agent, or Firm*—Macdonald J. Wiggins

[57] ABSTRACT

An educational word game apparatus utilizes a board with a diamond shaped playing area formed in a checkerboard pattern. A pair of goals is provided and players more playing tiles over the checkerboard squares toward the goal according to a roll of a die. A large deck of word cards is provided with each card having a word on one side and the meaning thereof on the other side. At each roll of the die, a player draws a card and chooses to either define or spell the word. If the correct answer is given, the player may advance a playing tile. The first player to move a certain number of playing tiles to his goal is the winner. A goal may be the word ALPHABET and tiles having letters of this word are used to cover the corresponding letter when reached by a playing tile.

6 Claims, 4 Drawing Figures

32 propagate
(prop' ə-gāt')
30

FIG. 1
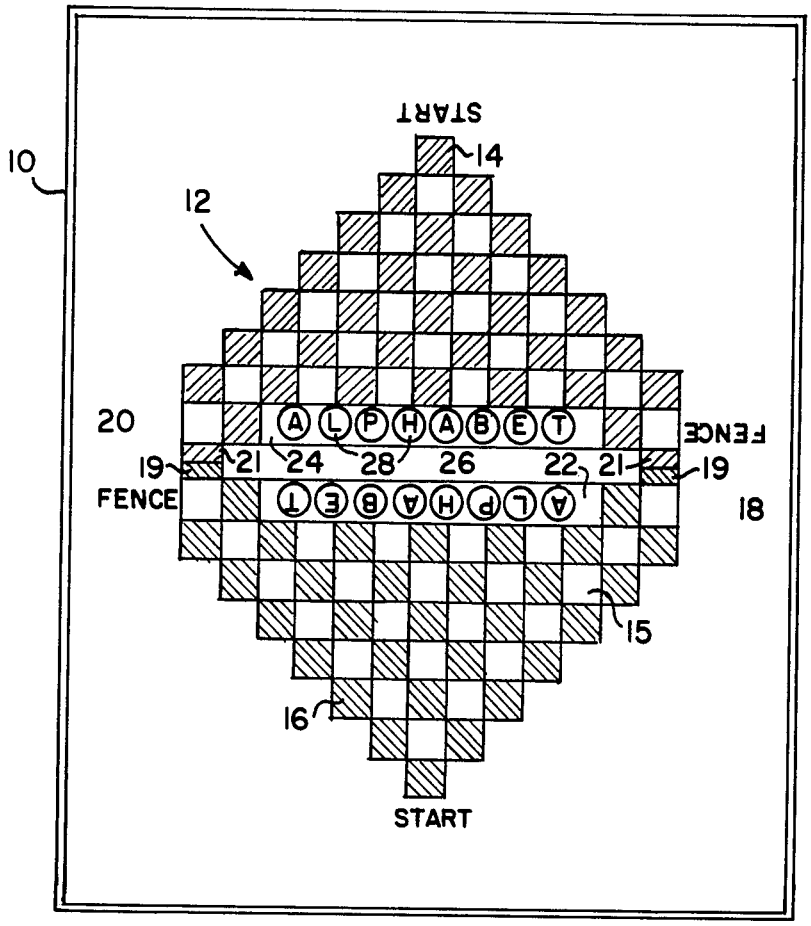
FIG. 2
32 propagate
(prop' ə-gāt')
30
FIG. 3
34 to reproduce, multiply
30
FIG. 4
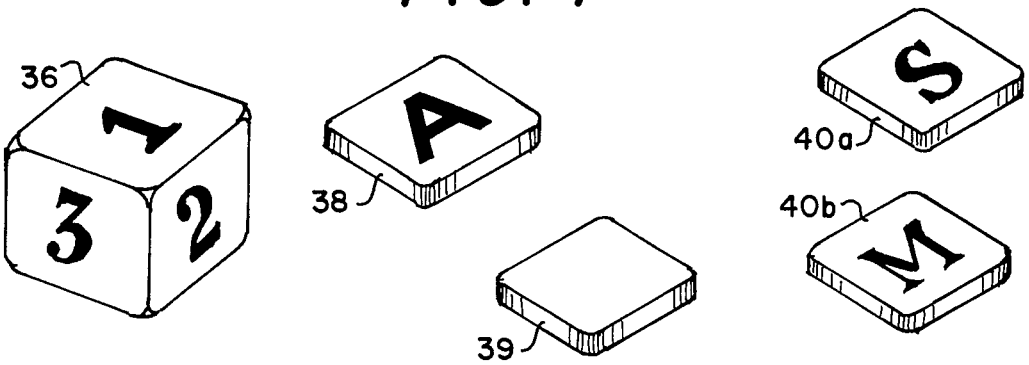

EDUCATIONAL GAME APPARATUS

BACKGROUND OF THE INVENTION

1. Field of the Invention

The present invention relates to educational board game apparatus, and more particularly to a game for improving the spelling capability and vocabulary of the players.

2. Description of the Prior Art

Games which are fun to play and which also have an educational aspect are very popular and useful, particularly among younger persons. Such games provide an interesting and an enjoyable pastime and may subconsciously increases the player's knowledge. There are a number of games known in the prior art of this nature, such as Scrabble® which improves vocabulary and spelling and has enjoyed great success. Other games of a similar type include that described in U.S. Pat. No. 4,572,513 to Evans in which a gameboard having spaces and a goal is provided. An audio recording contains questions and problems which a player must answer correctly to be able to move a piece along a path on the board to the goal. Sawyer, in U.S. Pat. No. 4,306,725, teaches a game involving cards having words to be defined. A gameboard with a spinning arrow is used in conjunction with the cards. Board games with squares over which tiles are moved are shown by de Cadier, U.S. Pat. No. 4,283,058, and Spohn in U.S. Pat. No. 3,901,513. Blackman, U.S. Pat. No. 4,043,560 discloses a board game using tiles and color coded dice.

SUMMARY OF THE INVENTION

My present invention is directed to educational board game apparatus for improving the vocabulary and the spelling ability of the players. A large deck of cards, for example 1,000 cards, may be provided, with each card having a word on one side and the meaning thereof on the opposite side. A board is provided having an essentially diamond-shaped playing area. One player or team sits on one side of the board and the opposing player or team sits on the opposite side of the board with opposite points of the diamond directed towards the players. The diamond is formed from alternate light and dark squares in a checkerboard pattern. Two rows along the center of the diamond each have the word ALPHABET spelled out with each letter of a size to fit into one of the squares. One alphabet word faces each player or team. A plurality of playing tiles is provided along with a die for each team. Each die includes the numbers from 1 to 6 on its faces as is common for dice and the like.

It is apparent that, with the elements of my board game, various sets of rules may be devised which will permit an enjoyable game to be played with a sense of competition between the players and which will require knowledge of spelling and the meaning of words. Such games will improve the player's knowledge as the games are played. It is also apparent that my game can be tailored to any age level by the selection of the word card deck. Easy words may be provided for young players and more difficult words for older players and for adults.

It is therefore a principal object of my invention to provide a simple, easy to play board game which will be both enjoyable and educational.

It is another object of my invention to provide board game apparatus having a board with a checkerboard-like playing area with goals across the center thereof, and playing tiles which are moved over the board by a player correctly spelling or defining a word, to reach such players goal.

It is still another object of my invention to provide an educational game that can be tailored to the age group of the players.

It is yet another object of my invention to provide structural game apparatus elements for which various sets of rules can be developed.

These and other objects and advantages of my invention will become apparent from the following detailed description when read in conjunction with the drawings.

BRIEF DESCRIPTION OF THE DRAWINGS

FIG. 1 is a plan view of a typical board in accordance with my invention;

FIG. 2 is a view of the front surface of a word card from the deck of word cards used in the game;

FIG. 3 is a view of the back surface of the word card of FIG. 2; and

FIG. 4 is a perspective view of the various elements used in playing of the game of my invention.

DETAILED DESCRIPTION OF THE PREFERRED EMBODIMENT

Referring to FIG. 1, a layout of the playing board 10 of my invention is shown. The board 10 may be of any desired size commensurate with the size of the playing tiles described below. However, a 15"×20" board is eminently suitable. A substantially diamond shaped playing area 12 is provided formed from a checkerboard-like pattern of light and dark squares. Dark squares 16 are used on one side of the board while on the opposite side of the board dark squares 14 are used which differ in appearance from dark squares 16. For example, one color may be selected for dark squares 14 to contrast with another color of dark squares 16. Squares 16, shown with right hand sloping cross-hatching, may be blue while dark squares 14 with left hand cross-hatching may, in a typical board, be red. Squares 15 are preferably white or of a light color to contrast with dark squares 14 and 16.

As may be noted, playing area 12 represents two pyramids placed base to base with the vertexes thereof adjacent the playing ends of the board 10. The bottom rows 18 and 20 of such pyramids are labeled "fence" rows. The two fence rows are separated at each end by a pair of squares each having a first half 21 of the same color as square 14 and a second half 19 having the same color as square 16. Fence row 20 includes a portion or line 24 having the letters A, L, P, H, A, B, E, and T in a line thereby spelling the word "ALPHABET" facing the lower end of board 10. Each letter in portion 24 may be placed within a colored ring or colored disc having the same color as squares 16. Similarly, the word "ALPHABET" is placed in portion 22 of fence row 18 inverted so that it faces the upper end of the board 10 as shown in FIG. 1. The rings or discs upon which the letters of the word ALPHABET of portion 22 are disposed match the color of squares 14. The squares at the top of each pyramid are called the START squares and are indicated by an appropriate legend.

A set of word cards is provided which may be in any desired form. However, a rectangular card 30, as shown in FIGS. 2 and 3, is preferred. FIG. 2 illustrates a typical card 30 having a word 32 on a first side thereof and which may be accompanied by a phonetic pronunciation legend in parentheses. The second side of card 30, shown in FIG. 3, has a brief definition of the word. In this example, the word "propagate" 32 of FIG. 2 is defined in FIG. 3 as meaning "to reproduce, multiply" 34. A sufficient number of cards 30 is preferred, such as from 100 to 1,000, to provide a large variety of words such that the game may be played many times without repeating words, and thereby to expose players to a large number of words. Similarly, various sets of word cards may be provided each having a different level of difficulty in either spelling or meaning. While FIGS. 2 and 3 show an English word and its definition, it will also be understood that the game may be used for practice of foreign languages by having the English word on one side of a card and the equivalent foreign language word on the opposite side of the card.

Turning now to FIG. 4, the remainder of the playing pieces is illustrated. A die 36 is shown having the numerals 1 through 6 on the faces thereof. During various versions of the game, a player will roll die 36 with the number appearing on the top face indicating the number of spaces which the player may advance his playing piece. A number of category tiles 40 is provided having an a and b side as indicated in FIG. 4. Side **40*a* carries the letter "S" to indicate "Spell" with the opposite side 40*b*** having the letter "M" to indicate "Meaning".

A plurality of blank tiles 39 is provided. These tiles 39 are called the playing tiles. Playing tiles 39 are selected in size to fit within a square 14 and 16. In one implementation, tiles ¾ inches square are used. Two sets of alphabet tiles 38 are utilized having sufficient tiles with the letters A, L, P, H, A, B, E, and T thereon of a size to cover the corresponding letters in rows 22 and 24 of the playing field 12 of FIG. 1.

Having provided the playing board 10, the vocabulary or word cards 30, and the playing pieces 36, 37, 39, 40, a number of games may be developed using these elements of my invention and which may all have basically the same objective. To illustrate, assume that squares 14 and the letters in line 22 are red, and squares 16 and the letters in line 24 are blue, a typical set of playing rules will be described. The object of this game is to move a playing tile from the START row on the blue side of playing field 12, moving only on the colored squares 16, past the fence row 20 into the squares 14 on the red side and onto one of the letters of the word ALPHABET in blue in line 24. Similarly, a player on the red side will be attempting to advance a playing tile 39 to the letters spelling ALPHABET in line 22. When a playing tile 39 is moved onto one of the ALPHABET letters, that tile is replaced with a tile 38 having the corresponding letter. The player who first covers all of the letters of the word ALPHABET with the corresponding lettered tiles 38 is the winner.

In this example, the first to play may be determined by a roll of die 36. The player who starts places a tile 40 on the board near the word START on that player's side of the board. The player then rolls his die and notes the number on the upper face thereof. Next, the player draws a card 30 from the box of word cards 30, and, without looking at the card, hands it to the other player. The other player then asks whether the first player wishes to spell the word or to define the word. After the first player makes his choice, he orients his tile 40 to either "S" or "M" depending upon whether he wishes to spell the word or give its meaning. The other player then reads the word and the first player attempts to spell the word or give its meaning. If the player is successful and gives the correct answer, he then takes a blank playing tile 39 and places it on the START square and moves forward a number of colored spaces equal to the number obtained from the die. If the player gives an incorrect answer, then he must wait the next turn for another chance.

The opposing player then rolls the die and repeats the process just completed by the first player. As the game proceeds in this fashion, the first player may move his playing tile 39 past fence row 18 to the opponent's fence row 20 and will thereafter move along the red squares. Since the object is to move the playing tile 39 to one of the letters in row 24, the player moving into row 20 will attempt to choose a path for the number of squares that he is permitted to move that will permit him to land on one of the letters of the word ALPHABET in line 24 at the last move. The opposing player will be attempting to reach the letters in line 22.

As previously mentioned, when a playing tile 39 is on one of the letters of the word ALPHABET in line 24 or 22, that tile is then removed and the tile 38 with the appropriate letter substituted therefor. This process continues until one of the players is successful in covering all of the letters of the word ALPHABET in his line 22 or 24. This player then is the winner.

Many variations of these rules will occur to the players and the game can be made either more difficult or easier as desired. To make the game more difficult, a rule may be instituted that, when a player gives the wrong answer to the question from the word card 30, he must back up the number of spaces indicated on his die. With such a rule, it may be noted that a player may be backed completely off of the playing field 12 and may then "owe" the game one or more squares before he can move his playing tile into START. Another rule may provide that if a playing tile being moved finishes up on top of an opponent's playing tile, then that opponent is required to remove his tile from the board and start over.

A typical game may be played by two persons, or by teams in which the players of each team take turns answering the questions posed by the word cards.

As will now be recognized, I have provided a simple educational board game apparatus suitable for playing a variety of word games requiring knowledge of spelling and meanings of words to be able to advance to the goal. The game may be played with very simple rules and simple words suitable for young children, and also played with more sophisticated rules and words of greater difficulty for adults. Thus, the whole family can participate at their own level, build their vocabularies and, at the same time, enjoy the competition that my intellectual game apparatus provides.

While I have disclosed specific exemplary structures, various modifications and variations therein may be made, and such changes are considered to fall within the spirit and scope of my invention.

I claim:

1. Educational board game apparatus comprising:

(a) a board having a playing field, said field having (i) a first essentially pyramidal design formed by a first checkerboard pattern having alternating first dark and light squares, a vertex thereof adjacent a first playing end of said board and a first base toward a second playing end of said board;

(ii) a second essentially pyramidal design formed by a second checkerboard pattern having alternating second dark and light squares, said second dark squares differing distinguishably from said first dark squares, a vertex thereof adjacent said second playing end of said board and a second base contiguous with said first base;

(iii) a first word ALPHABET having each letter of a size to fit into a square of said designs, said word disposed in a line within said first design, parallel to said first base, and oriented to be read from said second playing end, said word including means for associating the letters thereof with said second dark squares;

(iv) a second word ALPHABET having each letter of a size to fit into a square of said designs, said word disposed in a line within said second design, parallel with said second base, and oriented to be read from said first playing end, said word including means for associating the letters thereof with said first dark squares;

(b) a set of game word cards having a word printed on one side thereof and a definition of such word printed on the other side thereof, one of said cards being drawn by a player prior to each play of said game for providing a word to such player for spelling or definition prior to such play;

(c) a set of movable playing pieces including (i) a plurality of blank playing tiles having a size to fit within said squares for moving in increments over said playing field, (ii) a plurality of indicator tiles having the letter M on one face thereof and the letter S on an opposite face thereof for a player during play of said game to place on said board to indicate "spelling" or "meaning"

(iii) a plurality of alphabet tiles each alphabet tile having a letter thereon and being of a size to cover a letter of said word ALPHABET, said alphabet tiles having collectively at least twice the number of letters required to spell the word ALPHABET, said alphabet tiles serving to cover a corresponding letter of the word ALPHABET when a player's playing tile is moved thereon during play of said game; and (d) chance means for operation by a player to determine the number of increments of movement of a playing tile over said playing field when such player successfully spells or defines a word on one of said word cards drawn from said set.

2. The apparatus as recited in claim 1 in which said first dark squares are of a first color and said second dark squares are of a second color contrasting with said first color.

3. The apparatus as recited in claim 1 in which said chance means is at least one die.

4. The apparatus as recited in claim 1 in which said playing tiles are square.

5. The apparatus as recited in claim 1 in which said word cards are in the English language.

6. The apparatus as recited in claim 1 in which said word cards have a word in a foreign language on one side and a definition of said foreign word in the English language on the other side thereof.

* * * * *